United States Patent [19]

Moriya et al.

[11] Patent Number: 4,647,236

[45] Date of Patent: Mar. 3, 1987

[54] PRINT HEAD

[75] Inventors: Takashi Moriya; Makoto Yasunaga; Masahiko Ueda; Tetsuya Yamamoto, all of Tanashi, Japan

[73] Assignee: Citizen Watch Co., Ltd., Tokyo, Japan

[21] Appl. No.: 805,724

[22] Filed: Dec. 6, 1985

[30] Foreign Application Priority Data

Dec. 7, 1984 [JP] Japan ..... 59-185695[U]
Dec. 7, 1984 [JP] Japan ..... 59-258852

[51] Int. Cl.[4] ..... B41J 3/12
[52] U.S. Cl. ..... 400/124; 101/93.05
[58] Field of Search ..... 400/124; 101/93.05; 335/275, 276, 273

[56] References Cited

U.S. PATENT DOCUMENTS

| | | | |
|---|---|---|---|
| 4,197,021 | 4/1980 | Gomi | 400/124 |
| 4,204,778 | 5/1980 | Miyazawa | 400/124 |
| 4,244,658 | 1/1981 | Mori | 400/124 |
| 4,252,449 | 2/1981 | Miyazawa | 400/124 |
| 4,335,969 | 6/1982 | Ott | 400/124 |
| 4,375,338 | 3/1983 | Mitsuishi | 400/124 |
| 4,423,969 | 1/1984 | Kobryn | 400/124 |
| 4,518,269 | 5/1985 | Akazawa | 400/124 |
| 4,521,122 | 6/1985 | Schafer | 400/124 |

FOREIGN PATENT DOCUMENTS

| | | | |
|---|---|---|---|
| 154176 | 12/1980 | Japan | 400/124 |
| 224365 | 12/1984 | Japan | 400/124 |
| 2375 | 1/1985 | Japan | 400/124 |
| 2376 | 1/1985 | Japan | 400/124 |

*Primary Examiner*—Paul T. Sewell
*Attorney, Agent, or Firm*—Birch, Stewart, Kolasch & Birch

[57] ABSTRACT

A dot matrix print head comprises a print wire unit in which a plurality of print wires are slidably mounted, an electromagnet unit having a plurality of electromagnets, and an armature unit secured to the electromagnet unit. The armature unit has a cover, a spring plate having a plurality of projections, and a plurality of armatures. Each armature has a projection which is engaged with a hole formed in a sub-yoke. The engagement of the projection is kept by the projection of the spring plate.

6 Claims, 8 Drawing Figures

PRINT HEAD

BACKGROUND OF THE INVENTION

The present invention relates to a print head for a dot matrix printer, and more particularly to a structure for supporting an armature in the print head.

In the print head of the dot matrix printer disclosed in U.S. Pat. No. 4,204,778, a plurality of armatures (clappers) are securely mounted on a leaf spring by rivets and a projecting iron plunger is provided on each armature so as to be attracted to the core of an electromagnet. The plunger is projected through an opening of a yoke plate to the core. The free end of the leaf spring is held by a fulcrum arrester.

In assembling, since the armature is mounted on the leaf spring by the rivet, it is necessary to perform a large number of processes to assemble such a complex structure. Further, if the plunger is not accurately positioned on the armature, the plunger will not be properly located in the opening of the yoke plate, and may come in contact with the wall of the opening. Accordingly, high accuracy in the assembling of components is required. However, since the positioning of the plunger is decided by the leaf spring which is positioned through the electromagnet unit and a cover, it is difficult to locate the plunger with high accuracy.

SUMMARY OF THE INVENTION

The object of the present invention is to provide a dot matrix print head which may reduce the number of processes for assembling the print head and improve the accuracy of the device.

According to the present invention, there is provided a dot matrix print head having a print wire unit in which a plurality of print wires are slidably mounted, an electromagnet unit having a plurality of annularly arranged electromagnets and secured to the print wire unit, and an armature unit mounted on the electromagnet unit. The armature unit comprises a cover having a plurality of guiding grooves provided at a central portion thereof, and a spring plate disposed on an inside wall of the cover and having a plurality of projecting portions at a peripheral portion of the cover. The unit also has a plurality of armatures corresponding to the electromagnets and to the projecting portions of the spring plate, each armature having projections at the side opposite to the spring plate and at a base end portion of the armature, an arm portion slidably engaged with the guiding groove, and an annular sub-yoke secured to the cover. The sub-yoke has a plurality of holes each engaged with the projection of the armature, the spring plate being arranged to urge the armature to keep the engagement of projection with the hole of the sub-yoke.

In one aspect of the invention, the guiding grooves are formed in a center portion formed in the cover, the spring plate is an annular spring plate and projecting portions thereof are radially projected portions from the spring plate.

These and other objects and features of the present invention will become more apparent from the following description with reference to the accompanying drawings.

DESCRIPTION OF THE PREFERRED EMBODIMENT

Figure 1:
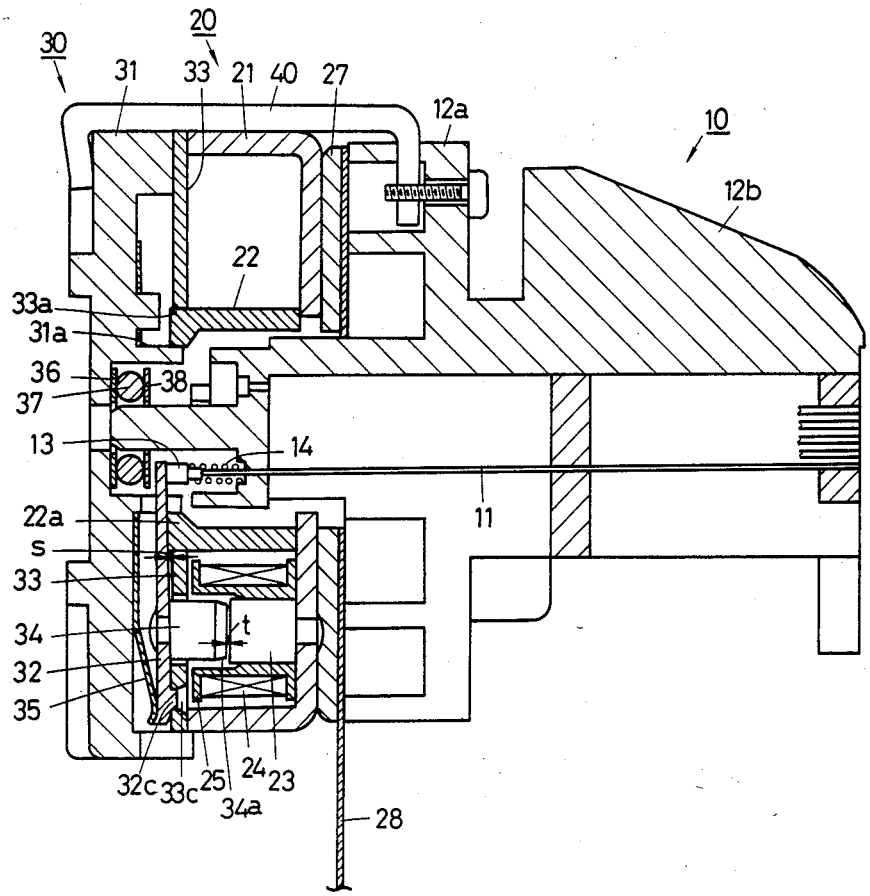
FIG. 1 is a sectional side view showing a print head for a dot matrix printer according to the present invention.

Referring to FIG. 1, a print head according to the present invention comprises a print wire unit 10, an electromagnet unit 20 mounted on the print wire unit 10, and an armature unit 30 mounted on the electromagnet unit 20. These units 10, 20 and 30 are integrally secured by clamp means 40.

Figure 2:
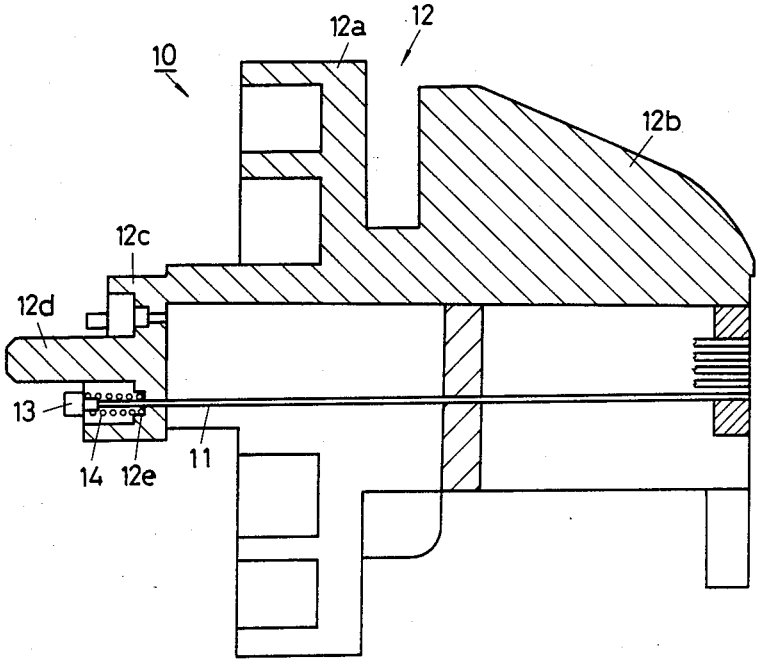
FIG. 2 is a sectional side view showing a print wire unit.

Referring to FIG. 2, the print wire unit 10 comprises a print wire guide body 12 and a plurality of print wires 11 axially slidably mounted in the body 12. The wire guide body 12 has a circular body portion 12*a* and a hollow wire guide nose 12*b* integral therewith. The body portion 12*a* is provided with a print wire guiding portion 12*c* and a post 12*d*. The guiding portion 12*c* is formed with a plurality of holes 12*e* surrounding the post 12*d*, each corresponding to print wire 11. The body portion 12*a* and guiding portion 12*c* have a plurality of holes, respectively, for slidably mounting print wires. Each of the print wires 11 is slidably supported in the guiding portion 12*c*, body portion 12*a* and nose 12*b*. Print wires 11 are circularly disposed in a rear portion of the print head, surrounding the post 12*d* and arranged on the flat portion at the front end of the nose 12*b*. Each of print wires 11 has an impact head 13 secured to the tip end thereof and a compression spring 14 disposed between the impact head 13 and guiding portion 12*c*. Thus, when the print wire 11 is mounted in the wire guide body 12, the print wire 11 is biased to the rear portion of the print head.

Figure 3A:
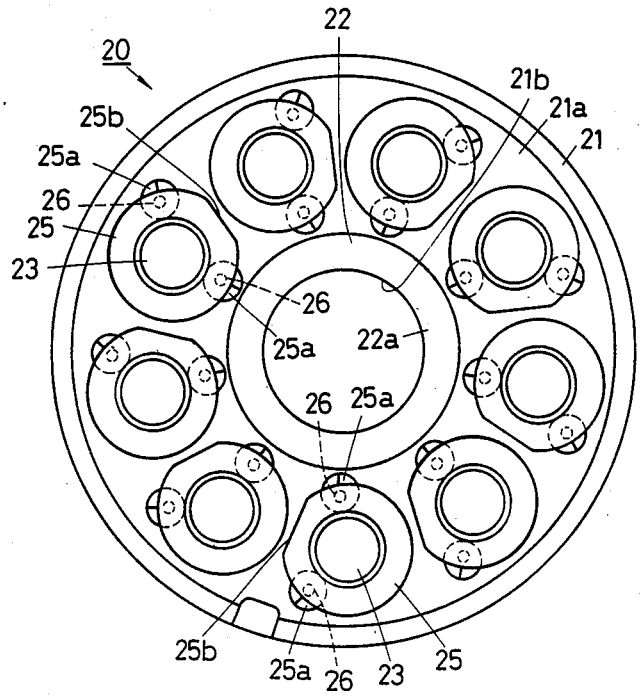
FIG. 3*a* is a plan view of the rear side of an electromagnet unit.
Figure 3B:
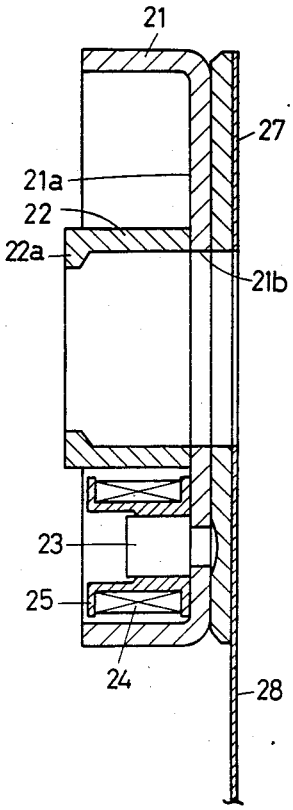
FIG. 3*b* is a sectional side view of the electromagnet unit.
Figure 4A:
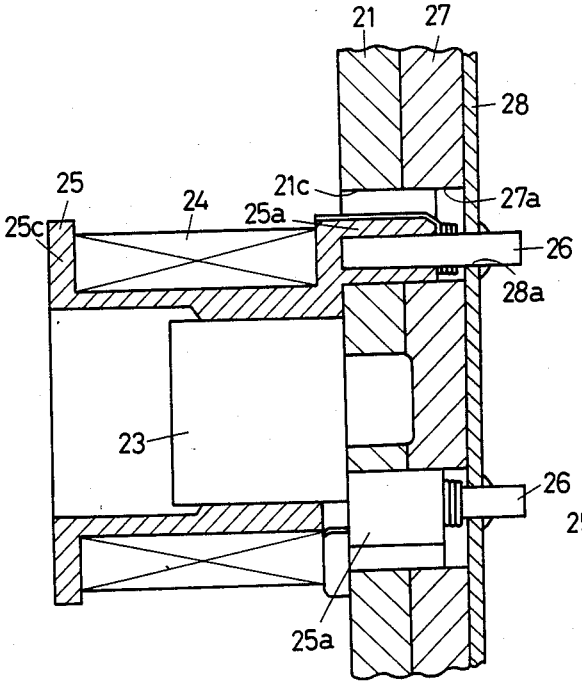
FIG. 4*a* is an enlarged sectional view showing a coil bobbin having an electromagnet coil secured to a core.
Figure 4B:
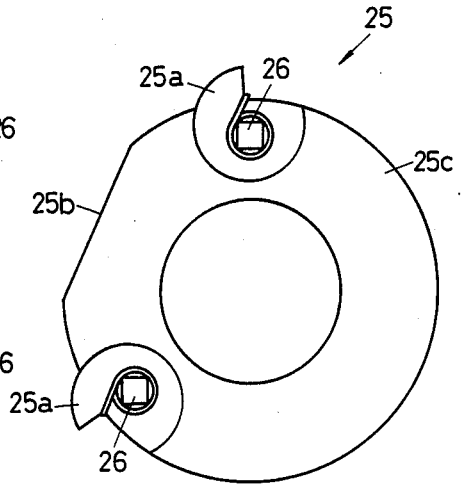
FIG. 4*b* is a plan view showing the rear side of the coil bobbin.

Referring to FIG. 3, the electromagnet unit 20 comprises a cylindrical main yoke 21 having a central opening 21*b* formed on a base plate 21*a* for receiving the print wire unit 10. A cylindrical center ring 22 made of non-magnetic material is secured to the base plate 21*a* by spot welding the surrounding of the central opening 21*b*. The center ring 22 has an inwardly projected peripheral portion 22*a*, and the top end thereof is projected from the main yoke 21. On the base plate 21*a*, a plurality of cores 23 are circularly disposed corresponding to the print wires 11 and secured to the base plate 21*a*. A coil bobbin 25 having a coil 24 is attached to each core 23, so that an electromagnet is formed. A flexible print cable 28 is secured to the base plate 21*a* through an insulation plate 27 opposite to the cores 23. As shown in FIG. 4, the coil bobbin 25 is provided with upper and lower flanges 25*c*, each of which has a flat 25*b* so as to avoid contact with adjacent bobbin. A pair of positioning legs 25*a* are formed on the lower flange 25c extended therefrom. Each of legs 25a has a conductive pin 26 embedded therein. Both ends of the coil 24 are respectively connected to the pins 26.

The base plate 21a of the main yoke 21 has positioning holes 21c and the insulation plate 27 has positioning holes 27a corresponding to holes 21c for receiving positioning legs 25a of the coil bobbin 25. Further, the print cable 28 has holes 28a corresponding to positioning holes 21c, and 27a for the conductive pins 26. In assembling, the positioning legs 25a with pins 26 are securely engaged with the positioning holes 21c and 27a, pins 26 are inserted into the holes 28a, and pins 26 are electrically connected to terminals on the board 28 by soldering. Thus, the bobbins 25, main yoke 21, insulation plate 27 and flexible print cable 28 are integrally assembled. Although, one flat 25b is formed on each flange 25c, a pair of flats may be formed on the flange diametrically opposite to each other.

Figure 5A:
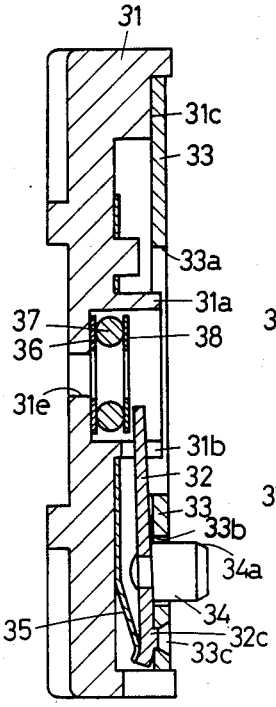
FIG. 5*a* is a sectional side view showing an armature unit.
Figure 5B:
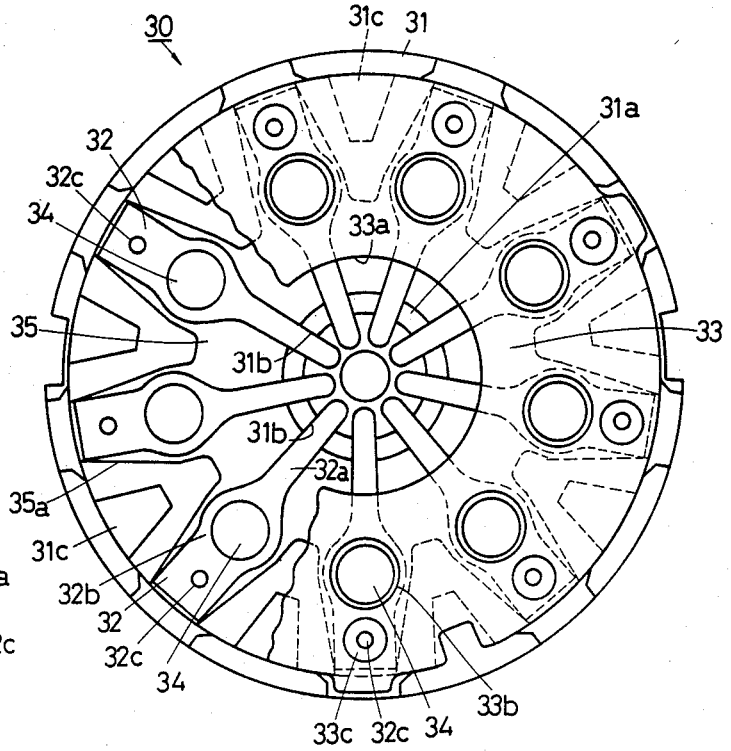
FIG. 5*b* is a front view of the armature unit.

Referring to FIG. 5, the armature unit 30 comprises a cover 31 to be engaged with the main yoke 21, a plurality of radially arranged armatures 32 for impacting the print wires 11, and an annular sub-yoke 33 mounted on the cover 31. The cover 31 has a cylindrical center portion 31a formed on the outside of a central hole 31e. The cylindrical center portion 31a has a smaller diameter than the center ring 22 so as to be engaged with the inside of the center ring 22. A plurality of guiding grooves 31b are formed on the end of cylindrical center portion 31a. In the cylindrical center portion 31a, a pair of annular thin plates 36, 38 are disposed, interposing an O-ring 37 made of rubber. Further, the cover 31 has a plurality of indented support portions 31c formed on the inner periphery for supporting the sub-yoke 33. Each armature 32 comprises an arm portion 32a engaged with the guiding groove 31b of the cylindrical center portion 31a and a base portion 32b positioned between support portions 31c. The base portion 32b has a plunger 34 secured thereto corresponding to the core 23 and a projection 32c formed at a base end portion outside the plunger 34. The plunger 34 is formed with a beveled end portion 34a so as not to come into contact with the bobbin 25. The sub-yoke 33 has a central opening 33a to be engaged with the center ring 22, a plurality of apartures 33b each allowing the plunger 34 to project, and a plurality of holes 33c each of which is engaged with the projection 32c of the armature 32 so as to permit the swing of the armature about an edge. An annular armature spring plate 35 having a plurality of radially projecting portions 35a is disposed between the cover 31 and armatures 32 and is engaged with the outer periphery of the cylinder portion 31a. Thus, when the armature 32 is mounted in the cover 31 and the sub-yoke 33 is securely engaged with the cover, the projection 32c of the armature is urged to the hole 33c of the sub-yoke 33 and the end of the arm portion 32a is abutted to the thin plate 38 by the elasticity of the spring plate 35.

In assembling, the thin plate 36, O-ring 37 and thin plate 38 are disposed in the cylindrical center portion 31a of the cover 31 and the armature spring plate 35 is mounted on the outside of the center portion 31a. Then, the arm portion 32a of the armature 32 is engaged with the guiding groove 31b of the cylindrical center portion 31a and the base portion 32b is disposed on the spring plate 35. The sub-yoke 33 is mounted on the support portions 31c of the cover 31 such that the plungers 34 secured to the armatures 32 are projected from apartures 33b and the projections 32c are engaged with the holes 33c. The peripheral edge of the sub-yoke 33 is engaged with the inner wall of the cover 31 with force fit. Thus, the armature 32 can be pivotally rotated about the projection 32c as a fulcrum.

In order to assemble the print head, respective units 10, 20 and 30 are previously assembled as hereinbefore described. Then, the main yoke 21 of the electromagnet unit 20 is mounted on the sub-yoke 33 of the armature unit 30 in such a manner that the plunger 34 projected from the aperture 33b is inserted into the coil bobbin 25 and the center ring 22 is engaged with the central opening 33a of the sub-yoke 33. The guiding portion 12c of the guide body 12 of the print wire unit 10 is inserted into the center ring 22 of the electromagnet unit 20 and the post 12d is engaged with the central hole 31e of the cover 31. The body portion 12a is abutted on the flexible printed board 28.

In assembled state, the top end of the center ring 22 is projected from the inside surface of the sub-yoke 33 about 60 μm. Therefore, when the armature 32 is abutted to the center ring 22 by excitation of the coil 24, a space s is provided between the armature 32 and the sub-yoke 33. At the same time, a space t is provided between the plunger 34 and the core 23.

In operation, when the coil 24 is not excited, the arm portion 32a of the armature 32 is biased to the plate 38 by the elastic force of the armature spring plate 35. When the electromagnet is energized, the plunger 34 is attracted to the core 23 and the armature 32 is pivotally rotated about the projection 32c engaged with the hole 33c of the sub-yoke 33 against the elasticity of the spring plate 35. Thus, the arm portion 32a impacts the impact head 13 to push the print wire 11 against the elastic force of the compression spring 14 to print a dot. Thereafter, the arm portion 32a strikes the top end of the center ring 22. At that time, the energization of the electromagnet has been cancelled, so that the armature 32 bounds back, rotating about the projection 32c and returned to the rest position by the elasticity of the armature spring 35. That is, the arm portion 32a is abutted to the thin plate 38. At the same time, the print wire 11 is returned to the rest position by the elasticity of the compression spring 14.

In accordance with the present invention, an armature comprises a projection formed on a base portion thereof to be loosely engaged with a hole formed in a sub-yoke as a fulcrum and an arm portion loosely guided by a guiding groove formed in a cylindrical center portion of a cover. Accordingly, the number of assembling prosesses is reduced and the accuracy of the device is improved. In addition, since spaces are formed between the plunger 34 and core 23 and between the armature 32 and sub-yoke 33, magnetism does not remain in the armature and plunger as residual magnetism. Accordingly, the armature returns quickly.

While the invention has been described in conjunction with preferred specific embodiments thereof, it will be understood that this description is intended to illustrate and not limit the scope of the invention, which is defined by the following claims.

What is claimed is:

1. In a dot matrix print head having:

a print wire unit in which a plurality of print wires are slidably mounted;

an electromagnet unit having a center ring made of non-magnetic material and electromagnets surrounding the center ring;

an armature unit mounted on the electromagnet unit, wherein the armature unit comprises a cover having guiding means provided at a central portion thereof;

a spring plate disposed on an inside wall of the cover and having a plurality of projecting portions at a peripheral portion of the cover;

an annular sub-yoke secured to the cover;

a plurality of armatures corresponding to the electromagnets and to the projecting portions of the spring plate, each armature being pivotally mounted on a pivot portion of the sub-yoke and urged by the spring plate to the pivot portion;

the center ring being projected from the sub-yoke, so that the armature abuts on the center ring without engaging the sub-yoke.

2. The dot matrix print head according to claim 1 wherein the guiding means provided in the cover is a plurality of guiding grooves provided in a cylindrical center portion.

3. The dot matrix print head according to claim 1 wherein each armature has a projection at the side opposite to the spring plate and at a base end portion of the armature, and an arm portion slidably engaged with the guiding groove, and the sub-yoke has a plurality of holes each engaged with the projection of the armature to form the pivot portion, the spring plate is arranged to urge the armature to keep the engagement of projection with the hole of the sub-yoke.

4. The dot matrix print head according to claim 1 wherein each armature has a plunger corresponding to the electromagnet.

5. The dot matrix print head according to claim 1 wherein the spring plate is an annular spring plate and projecting portions thereof are radially projected portions from the spring plate.

6. The dot matrix print head according to claim 5 wherein the projecting portion acts to urge the armature to the rest position thereof.

* * * * *